US005396705A

United States Patent [19]

Leini

[11] Patent Number: 5,396,705

[45] Date of Patent: Mar. 14, 1995

[54] MOUNTING BASE FOR GUIDEBARS

[75] Inventor: Arvo Leini, Edsbyn, Sweden

[73] Assignee: Sandvik AB, Sandviken, Sweden

[21] Appl. No.: 66,114

[22] PCT Filed: Dec. 9, 1991

[86] PCT No.: PCT/SE91/00847

§ 371 Date: Jul. 15, 1993

§ 102(e) Date: Jul. 15, 1993

[87] PCT Pub. No.: WO92/10340

PCT Pub. Date: Jun. 25, 1992

[30] Foreign Application Priority Data

Dec. 10, 1990 [SE] Sweden ..... 9003926

[51] Int. Cl.[6] ..... B27B 17/14

[52] U.S. Cl. ..... 30/386; 144/34 R; 83/819

[58] Field of Search ..... 30/383, 384, 386; 83/816, 814, 818, 819; 144/73, 34 R; 137/625.27, 533.25

[56] References Cited

U.S. PATENT DOCUMENTS

| | | | |
|---|---|---|---|
| 2,316,997 | 4/1943 | Smith | 143/32 |
| 2,357,230 | 8/1944 | Shade | 30/383 |
| 2,532,981 | 12/1950 | Wolfe | 143/32 |
| 3,194,284 | 7/1965 | Walker | 143/32 |
| 3,232,325 | 2/1966 | Hamilton | 83/819 |
| 3,279,508 | 10/1966 | Ehlen et al. | 143/32 |
| 3,636,995 | 1/1972 | Newman | 143/32 J |
| 3,884,266 | 5/1975 | Kondo | 137/625.27 |
| 3,991,799 | 11/1976 | Albright | 144/34 R |
| 4,116,250 | 9/1978 | Ericsson | 144/34 R |
| 4,161,200 | 7/1979 | Albright | 144/34 R |
| 4,219,059 | 8/1980 | Albright | 144/34 R |
| 4,382,334 | 5/1983 | Reynolds | 30/386 |
| 4,486,963 | 11/1984 | Koike et al. | 34/116 |
| 4,552,191 | 11/1985 | Kuusilinna | 144/3 D |

FOREIGN PATENT DOCUMENTS 745440 7/1980 U.S.S.R. .

*Primary Examiner*—Eugenia Jones
*Assistant Examiner*—Allan M. Schrock
*Attorney, Agent, or Firm*—Burns, Doane, Swecker & Mathis

[57] ABSTRACT

A mounting base for chain saw guidebars, comprising a plate (11) with a slot (14) in which a guide piece (36) can slide in the lengthwise direction of the guidebar, said guide piece being acted on by one or more pistons (17) energized by a self-contained pressure source (19) preferably comprising a gas spring, and a valve device (18) which can be set in different positions, during sawing urging the guidebar outwards with a predetermined force and preventing displacement inwards, and during changing of saw chain or guidebar permitting displacement inwards of the guidebar while preventing the pistons (17) from urging the guidebar outwards.

11 Claims, 2 Drawing Sheets

MOUNTING BASE FOR GUIDEBARS

BACKGROUND

Tree harvesting machines with saw chain and guidebar of types corresponding to those used with hand-held chain saws are known from among others the patents U.S. Pat. No. 3,991,799, 4,116,250, 4,161,200, 4,219,059 and 4,552,191. In these the guidebar is attached to a mounting base rotatable around the driving shaft from the motor to the drive sprocket for the saw chain. The guidebar and saw chain are advanced towards the tree to be felled by a hydraulic cylinder acting on the mounting base or a shaft connected to it.

In tree harvesting machines the saw chain is highly stressed, runs at high speeds and wears rapidly. This leads to expensive downtime for changing or tensioning of the saw chain, and to the possibility that the saw chain becomes so slack that it will jump off the guidebar.

It is important for the safety that the saw chain is tensioned with appropriate force, since too low force might allow the links of the chain to tilt and leave the guiding groove of the guidebar, and too high force will impair the lubrication of the saw chain and wear the rivets too soon.

In prior art, the tensioning force in the saw chain is normally adjusted by loosening the bolts holding the guidebar, followed by moving the guidebar lengthwise by a screw mechanism, and finally retightening said bolts. This does not ensure proper control of the tensioning force since there is no means for measuring the force, and since the force is affected by wear and temperature rise of the saw chain in use.

This adjustment procedure requires that the machine is stopped, and that the operator or another skilled person performs the adjustment with appropriate tools. The loss of production time and the need to leave the operator's cab make it likely that the adjustment is seldom done except when the saw chain or the guidebar has to be changed, which is too infrequent.

SUMMARY OF THE DISCLOSURE

The invention is a mounting base for a guidebar with an automatic tensioning device which holds the saw chain tensioned with a predetermined force without any action from the operator, and which allows a quick change of the saw chain without need for loosening of any bolts. This permits more operating time and improved lifetime of the saw chain.

Automatic tensioning of the saw chain is known in prior art from the patents U.S. Pat. No. 3,194,284 and 3,636,995, where a mechanical spring in the mounting base urges the guidebar outwards, U.S. Pat. No. 2,316,997 where a spring in the machine urges the nose part of the guidebar outwards by a lever connection, U.S. Pat. No. 2,532,981 and 4,486,963 where said nose part is urged outwards by a spring within the guidebar, and U.S. Pat. No. 3,279,508 where the whole guidebar is urged outwards by a spring in the guidebar. In practice, none of these arrangements has been a success, since a guidebar urged outwards by a mechanical spring with a force suited to the saw chain can also be urged inwards by some undesired external force acting on the nose part of the guidebar, such as when felling closely standing trees, with the result that the tension in the saw chain is lost so that it jumps off the groove in the guidebar. This can also happen if the tree to be felled leans backward and the non-cutting part of the saw chain is jammed. A method is shown in U.S. Pat. No. 4,486,963 to make the force required for inward displacement of the guidebar is higher than the force urging the guidebar outwards, but since this method depends on dry friction, it does not function properly in practice due to the effect of generous lubrication and strong vibrations in the guidebar.

The invention describes a mounting base designed to urge the guidebar outwards with a limited and predetermined force, still leaving the guidebar totally unaffected by external forces against the nose part of the guidebar.

A mounting base according to the invention comprises a rigid plate, rotatably journalled around the drive shaft. In the plate is a radial slot, along which a guide piece can slide, said guide piece being attached to the guidebar, as well as a joint where a hydraulic cylinder applies the force needed to rotate the mounting base with the guidebar. A piston extends from the plate into the slot, acting on the guide piece to urge the guidebar outwards. The pressure on the piston is hydraulically transmitted from a self-contained pressure source within the plate, said pressure source preferentially comprising a gas spring.

Between the piston and the pressure source is a valve device, adjustable with an external handle to either of three positions: closed, open or one-way from the pressure source to the piston. During sawing the valve device is in its one-way position, urging the guidebar outwards and keeping the saw chain tensioned, while external forces against the guidebar can not displace the guidebar inwards.

For changeing of saw chain or guidebar, the valve is set to its open position, and the guidebar is displaced inwards with a lever, followed by setting the valve to its closed position, thereby locking the piston in its inner position. The saw chain or the guidebar can then easily be changed.

BRIEF DESCRIPTION OF DRAWINGS

The invention is described in more detail with reference to the figures, where.

DETAILED DESCRIPTION OF THE PREFERRED EMBODIMENTS

Figure 1:
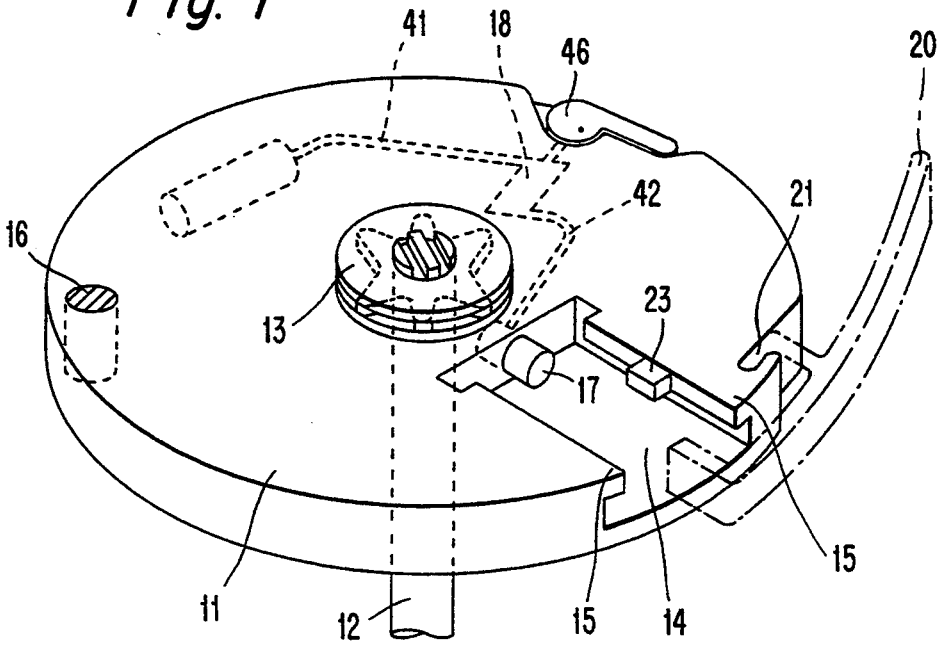
FIG. 1 shows the mounting base with the drive shaft seen from below.

FIG. 1 shows the underside of the mounting base, comprising a plate (11) rotatably journalled around a shaft (12) which at its end carries a drive sprocket (13) for the saw chain. In the plate is a radial slot (14) with fixed ribs (15). Near the periphery of the plate is a hole (16) which is part of a joint where a hydraulic cylinder applies the force needed to rotate the mounting base and the guidebar during sawing.

A piston (17) extends from the plate into the slot (14). The piston is (18) connected to a self-contained pressure source (19) in the plate (11) by means of fluid channels (41,42) and a valve device (18) said pressure source comprising a spring, which may be a mechanical spring but preferentially a gas spring with less volume and a well defined pressure. If it is not possible to fit a piston (17) of sufficient diameter within the thickness of the plate (11) two smaller pistons in parallel can be used. Adjoining the radial slot (14) is a notch (21) where a lever (20) can be temporarily attached with the help of which the guidebar (35) can be displaced inwards along the radial slot (14) for change of saw chain.

Figure 2:
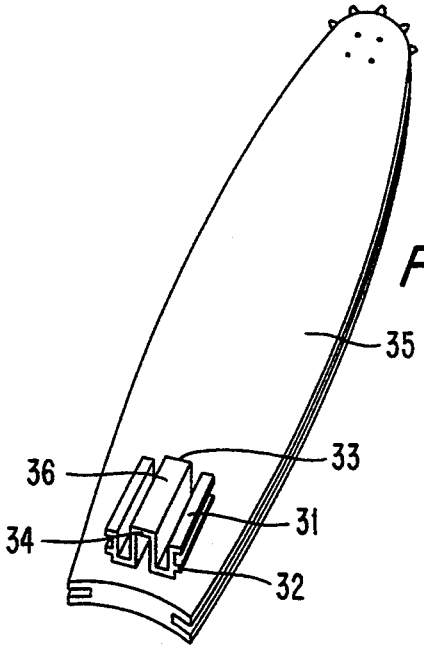
FIG. 2 shows the guidebar with the guide piece.
Figure 3:
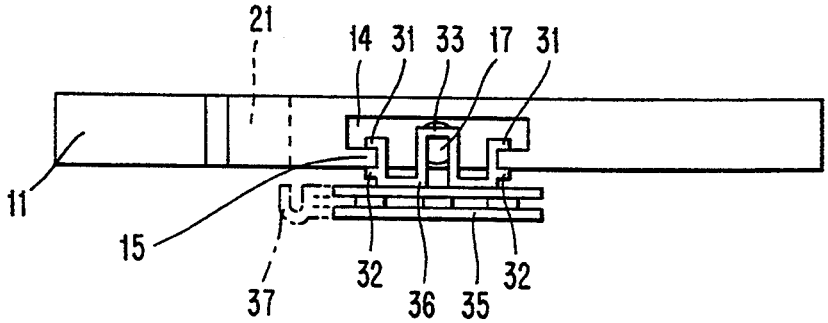
FIG. 3 the mounting base and the guidebar seen from the nose of the guidebar, FIGS. 4 and 5 two versions of the valve device.

FIG. 2 shows the upper side of the guidebar (35) around the edge of which the saw chain (37) is guided in a groove, and FIG. 3 shows the plate (11) and the guidebar (35) seen from the nose of the guidebar. On the upper side of the guidebar (35) is a guide piece (36) attached, permanently by riveting or welding, or detachably by bolts.

The guide piece (36) is provided with guiding ribs (31,32) co-operating with the fixed ribs (15) of the plate (11) to make the guidebar (35) easily slideable along the radial slot (14) without change of direction. The guide piece (36) has a rear contact surface (34) where the piston (17) applies a force urging the guidebar (35) outwards until the saw chain (37) is tensioned, and a front contact surface (33) against which the lever (20) acts to displace the guidebar inwards for changing of saw chain. The ribs (15,31,32) locate the guidebar (35) far enough from the plane of the plate (11) to let the saw chain (37) run freely.

Figure 4:
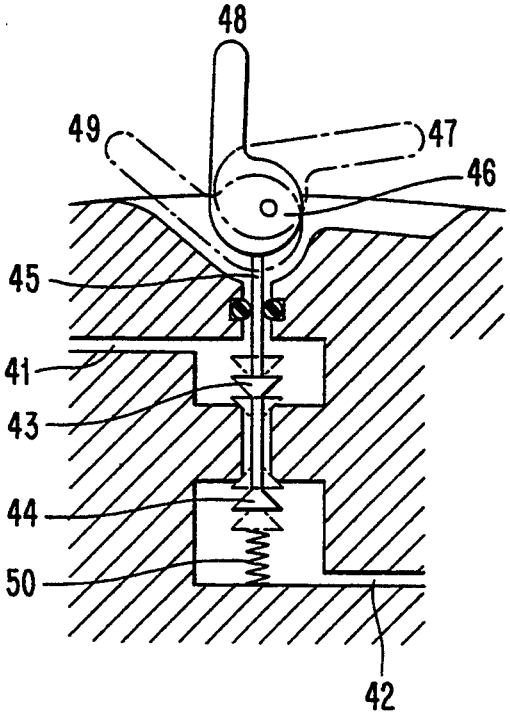

FIG. 4 shows a section through one embodiment of the valve device (18), connected to the pressure source (19) through a channel (41) and connected to the piston (17) through a second channel (42). The valve device (18) comprises two valve cones (43,44), a shaft (45) and a spring (50). The shaft (45) can be depressed to different depths by an eccentric (46) with a handle. The middle position (48) of the handle is the open position with both valve cones (43,44) free of their seats and free passage of the fluid in both directions through the valve device. In this position the guidebar (35) can be displayed inwards by the lever (20), with fluid moving from the piston (17) through the valve device to the pressure source (19). When the handle is then set to the closed position (49) the shaft (45) is further depressed by the eccentric (46) and the upper valve cone (43) closes to leave the piston (17) locked in its inner position. The saw chain is then slack and can easily be changed. In this position the guidebar (35) can also be removed for change or maintenance.

After fitting of a new saw chain or guidebar, the handle is moved to the middle open position (48) letting the piston (17) extend to tension the saw chain. During sawing the handle should be in its one-way position (47) when the lower valve cone (44) is held against its seat with a small force by the spring (50), allowing fluid to move from the pressure source (19) to the piston (17) to keep the saw chain tensioned even if the saw chain is lengthened by temperature or wear, while blocking any inwards displacement of the guidebar (35) and the piston (17).

Figure 5:
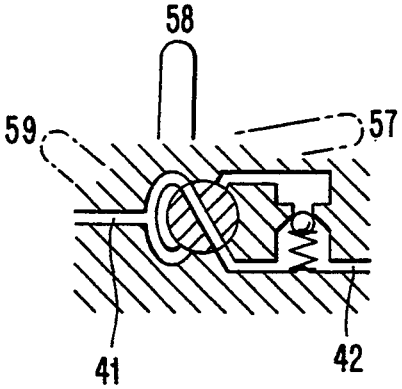

The valve device (18) can be built with the same function from other known components, a second embodiment of which is shown in FIG. 5 comprising a rotary valve combined with a spring loaded return valve. In this embodiment the rotary valve can be set in three positions: a closed (59), an open (58) and a one-way position (57).

The valve device can also be made with two one-way positions, where in the first position fluid can move only from the pressure source (19) to the piston (17), and in the second position only from the piston (17) to the pressure source (19). This could be accomplished in a valve device according to FIG. 4 by making the upper valve cone (43) mobile to a limited extent along the shaft (45) but spring-loaded to let it be lifted from its seat by fluid moving from the piston (17) to the pressure source (19) while the handle is in the closed position (49). The open middle position (48) of the handle is then not needed. The valve device of FIG. 5 can be correspondingly modified by using two return valves, the first placed as in the figure letting the fluid move from the pressure source (19) to the channel (42) leading to the piston (17) when the handle is in the first one-way position (57), and the second placed between the rotary valve and the channel (42), letting fluid move from the piston (17) through the channel (42) and the rotary valve to the pressure source (19) when the handle is in the second one-way position (58).

Figure 6:
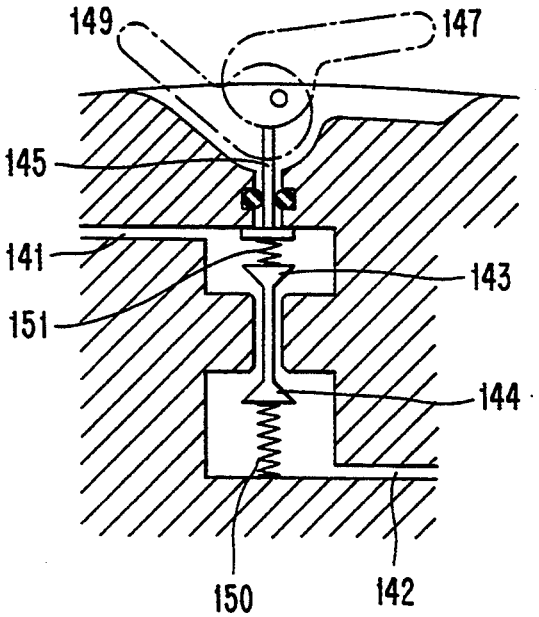
FIG. 6 discloses a valve having two one-way positions.

FIG. 6 disclose such a valve having two one-way positions, which have been known in the art. The valve includes a pressure rod 145 that is separated from a valve body 143, 144 by a spring 151. In the first position 147, the lower valve cone 144 touches the seat but can be moved down by pressure from fluid entering through passage 141. In the second position 149, the upper valve cone 143 touches the seat but can be moved up by fluid entering through passage 142.

To prevent loss of the guidebar if the saw chain breaks, it is suitable to install a releasable catch (23) on the fixed ribs (15), keeping the guide piece (36) from sliding out from the slot (14). If the guidebar is to be changed, the catch is manually released.

The invention has been described in relation to its use in vehicle mounted tree harvester machines, but can also be used in hand-held chain saws. In such applications the plate (11) need not be rotatable, but should be attached to the motor housing, and the lever (20) for displacing the guide piece (36) can be permanently mounted. The valve device (18) and the pressure source (19) can be located in the motor housing.

I claim:

1. A mounting base for a chain saw guidebar, comprising:

a plate having a slot in which a guide piece on the guidebar slides in a lengthwise direction of the guidebar;

at least one piston extending from the plate into the slot for acting on said guide piece;

a valve device mounted within the plate and connected through a first fluid channel to the piston, said valve device having a plurality of positions;

a self contained pressure source mounted within the plate and connected to the valve device through a second fluid channel;

a first position of the valve device allowing fluid to move from the pressure source to the piston;

a second position of the valve device allowing fluid to move from the piston to the pressure source; and a third position of the valve device preventing fluid from moving from the pressure source to the piston.

2. The mounting base according to claim 1, wherein the first position of the valve device allows fluid to move from the pressure source to the piston, but but not in the opposite direction; the second position of the valve device allows fluid to move in both directions; and the third position of the valve device prevents fluid from moving in any direction.

3. The mounting base according to claim 1, wherein the pressure source comprises a gas spring.

4. The mounting base according to claim 2, wherein the pressure source comprises a gas spring.

5. The mounting base according to claim 1, further comprising a manually releasable catch preventing the guide piece on the guidebar from leaving the slot.

6. The mounting base according to claim 2, further comprising a manually releasable catch preventing the guide piece on the guidebar from leaving the slot.

7. The mounting base according to claim 3, further comprising a manually releasable catch preventing the guide piece on the guidebar from leaving the slot.

8. A mounting base for a chain saw guidebar, comprising:

a plate having a slot in which a guide piece on the guidebar slides in a lengthwise direction of the guidebar;

at least one piston extending from the plate into the slot for acting on said guide piece;

a valve device mounted within the plate and connected through a first fluid channel to the piston, said valve device having a plurality of positions;

a self contained pressure source mounted within the plate and connected to the valve device through a second fluid channel;

a first position of the valve device allowing fluid to move from the pressure source to the piston, but not in the opposite direction; and a second position of the valve device allowing fluid to move from the piston to the pressure source, but not in the opposite direction.

9. The mounting base according to claim 8, wherein the pressure source comprises a gas spring.

10. The mounting base according to claim 8, further comprising a manually releasable catch preventing the guide piece on the guidebar from leaving the slot.

11. The mounting base according to claim 9, further comprising a manually releasable catch preventing the guide piece on the guidebar from leaving the slot.

* * * * *